United States Patent [19]

Wirth, Jr.

[11] Patent Number: 4,512,800

[45] Date of Patent: Apr. 23, 1985

[54] WIRE INJECTION APPARATUS

[75] Inventor: Emil J. Wirth, Jr., Yardley, Pa.

[73] Assignee: Pfizer Inc., New York, N.Y.

[21] Appl. No.: 522,753

[22] Filed: Aug. 12, 1983

[51] Int. Cl.[3] ..... C21C 7/00

[52] U.S. Cl. ..... 75/53; 266/216

[58] Field of Search ..... 75/53; 266/216

[56] References Cited

U.S. PATENT DOCUMENTS

| | | | |
|---|---|---|---|
| 905,948 | 12/1908 | Stromborg . | |
| 2,577,837 | 12/1951 | Zifferer | 75/129 |
| 3,137,753 | 6/1964 | Feichtinger | 266/34 |
| 3,331,680 | 7/1967 | Leupold | 75/53 |
| 3,558,119 | 1/1971 | Demelander | 266/41 |
| 3,567,202 | 3/1971 | Mercatoris et al. | 266/34 |
| 3,650,516 | 3/1972 | Mantell et al. | 266/34 T |
| 3,778,250 | 12/1973 | Bernsmann | 75/58 |
| 3,871,870 | 3/1975 | Nemoto et al. | 75/58 |
| 3,911,993 | 10/1975 | Caudill et al. | 164/55 |
| 3,954,134 | 5/1976 | Maas | 266/216 |
| 4,010,938 | 3/1977 | Crudup | 266/216 |
| 4,154,604 | 5/1979 | Gruner | 75/53 |
| 4,244,562 | 1/1981 | Archenholtz | 266/216 |
| 4,278,240 | 7/1981 | Archenholtz | 266/216 |
| 4,286,773 | 9/1981 | Kristiansen et al. | 266/44 |
| 4,423,858 | 1/1984 | Ostlund | 266/270 |

*Primary Examiner*—Peter D. Rosenberg

*Attorney, Agent, or Firm*—Charles J. Knuth; Peter C. Richardson; Lawrence C. Akers

[57] ABSTRACT

An apparatus for adding wire-form processing elements directly into a molten material, comprising: a heat resistant nozzle positionable relative to the surface of the molten material such that an inlet is disposed above the surface and an outlet is disposed beneath the surface; a mechanism for feeding the wire through the nozzle directly into the molten material; and a system for injecting a substantially inert gaseous medium into the molten material together with the wire, whereby the inert gas substantially prevents closure of the nozzle by solidified molten material and promotes mixture of the processing elements with the molten material through gas bubble agitation. The apparatus further comprises a substantially gas-tight conduit connected to the nozzle inlet, through which the wire and the inert gaseous medium are delivered to the nozzle. A pressure-driven seal prevents atmospheric contamination and prevents loss of inert gas. Passing the wire and gaseous medium through a bore in the nozzle having an elongated, gradually tapered funnel-shaped section adjacent the outlet maximizes the effect of the inert gaseous medium.

24 Claims, 8 Drawing Figures

WIRE INJECTION APPARATUS

BACKGROUND OF THE INVENTION

This invention relates to the field of processing of molten metals, and in particular to an apparatus for adding refining or alloying ingredients to improve properties of metal being processed.

In connection with the processing of molten metals, and in particular iron, steel and the like, it is known to add small amounts of elements such as calcium to the metal in its molten state in order to deoxidize and/or desulphurize the metal. Trace elements on the order of parts per million have substantial beneficial effects on the final product.

In metal processing, and in particular steel processing, molten metal generally is separated from a quantity of slag which remains relatively solid and floats upon the surface of the molten metal. The slag is made up of various lower-density impurities, quantities of oxidized metals and the like. In order to feed an additive material into the molten metal, the additive must be placed below or caused to pass through the slag surface. Unfortunately, merely feeding the material onto the surface of the molten metal in the form of a wire tends to accumulate unnecessarily high concentrations of the additive near the point of feeding and to waste a quantity of additive in the slag. Moreover, inasmuch as the additive material is not homogeneously mixed throughout the metal, a larger overall quantity of additive is required in order to reach the minimum concentrations required throughout the metal.

Addition of an additive material below the surface of a molten material involves certain considerations. Of course, an injection device must be employed which will not melt immediately when placed in the molten material. This having been accomplished, for example, by cooling the injection device and/or use of a refractory material, some provision must be made to prevent the solidification of molten metal on the surfaces of the injection device. In attempting to introduce material below the surface of molten metal through a feeding nozzle, the molten metal tends to enter the feeding nozzle and bind to internal nozzle portions, thereby stopping the feed.

Although it is known to treat processed steel with calcium in order to improve quality by reducing the effects of sulphur, it should be noted that steel processing is highly competitive in terms of cost. Many of the manufacturing processes are widely known and practiced in virtually identical form, such that a relatively minor difference in cost between producers is sufficient to swing a larger share of the demand to the lower cost product. Of course, additive materials intended to improve the properties of the steel are relatively expensive and must be conserved. Any waste of a calcium-containing additive material, for example by the loss of material in the slag layer during addition, has a major impact on the producer and the product. It is therefore highly desirable to feed the calcium well below the surface of the molten metal to the point where it will be most effective, and to mix the molten metal to evenly distribute the calcium additive therein.

The apparatus of the present invention is intended to facilitate the feed of additive materials, such as calcium-containing materials in the form of wire, to molten metals and is particularly suited for use in the method disclosed in the concurrently filed, copending, commonly assigned U.S. patent application of Joseph G. Kaiser entitled "Process for Adding Calcium to a Bath of Molten Ferrous Material", Ser. No. 522,754 filed Aug. 12, 1983.

SUMMARY OF THE INVENTION

It is an object of the invention to provide an apparatus for efficiently adding metal processing additives to quantities of molten metal.

It is also an object of the invention to facilitate the addition of calcium to iron and steel in the molten state, during processing thereof.

It is yet another object of the invention to add additives to molten metal using an apparatus that is inexpensive, convenient in use, effective in starting, stopping and during use, and requires use of the least amount of additive necessary to achieve a given concentration in the processed metal.

These and other objects of the invention are accomplished with a novel apparatus for adding a processing element in the form of a wire directly into a quantity of molten material, said apparatus comprising a heat-resistant nozzle having an outlet disposable beneath the surface of the molten material, means for feeding the wire into the nozzle, and means for concurrently injecting an inert gaseous medium into the nozzle together with the wire, thereby preventing closure of the nozzle by solidification of molten material therein while agitating the molten material by gas bubble agitation. A seal device having opposed, pressure-biased pistons engages the wire upstream (relative to wire feed) of the source of inert gas, which gas is fed together with the wire through a gas-tight conduit to the nozzle. A particular configuration of the bore of the nozzle maximizes the effect of the inert gas. A restriction in the flow path adjacent the outlet of the nozzle creates an area of increased gas velocity, whereby any irregularities which may occur in the feeding of wire do not give rise to the passage of molten metal into the interior of the nozzle.

DETAILED DESCRIPTION OF THE INVENTION

There are shown in the drawings the embodiments which are presently preferred. It should be understood, however, that the invention is not limited to the precise arrangements and instrumentalities shown, but is limited only by the scope of the claims. In the drawings:

Figure 1:
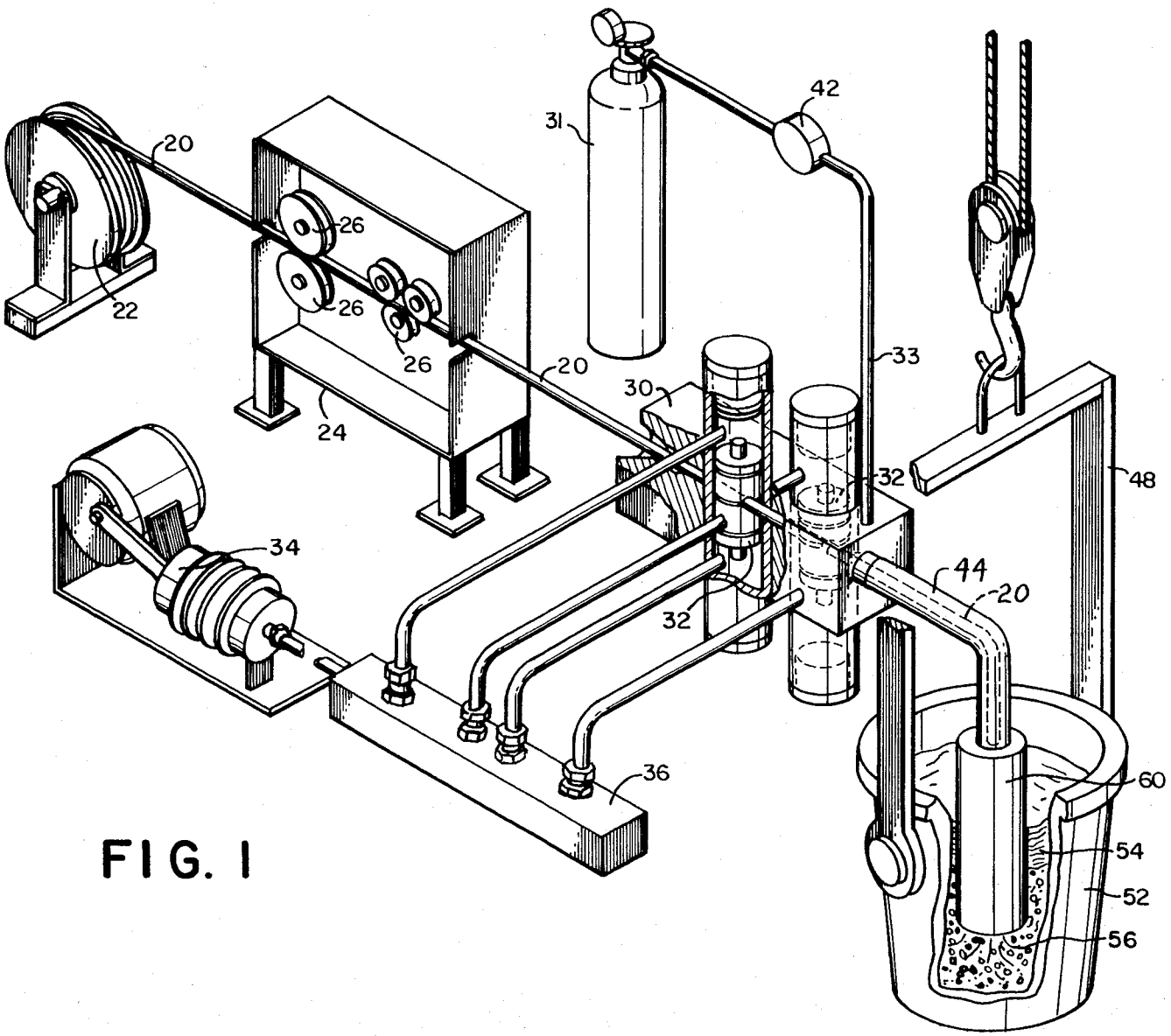
FIG. 1 is a schematic perspective representation of an apparatus of the invention.

One or more processing elements for treating a molten metal product are disposed in, or otherwise form a part of, a wire 20. Such elements are hereinafter sometimes referred to as being in wire-form. With reference to FIG. 1 (a schematic view), the general objective is to convey the wire 20 from reel 22 to the quantity of molten metal 56 in receptable 52. In order to accomplish such feeding, a feeding mechanism 24 draws the wire from the reel and advances the wire along a feed path. Adjacent the output portion, especially in the vicinity of nozzle 60, the wire 20 is carried in a gas-tight conduit 44. Inert gas is supplied to the gas-tight conduit, and a seal mechanism 30 located immediately upstream of the inert gas input prevents loss of inert gas around wire 20 in a direction backwards along the feed path.

Reference can be made to U.S. Pat. No. 4,235,362 for a description of a suitable feed mechanism 24, including pinch rollers 26. A wide range of wire sizes and compositions are possible, including both sheathed and unsheathed wires. The invention will be described in detail, however, with reference to sheathed calcium-containing wire of approximately one cm. diameter. Wires of this diameter, and wires of somewhat smaller diameter, are relatively rigid. Accordingly, the feed mechanism as well as the wire-carrying members must be capable of withstanding rough wear. Moreover, it should be expected that during feeding the relatively rigid wire will be prone to a certain amount of vibration and transverse displacement due to encountering discontinuities along the feed path, and due to bumps and bends in the wire.

Figure 2:
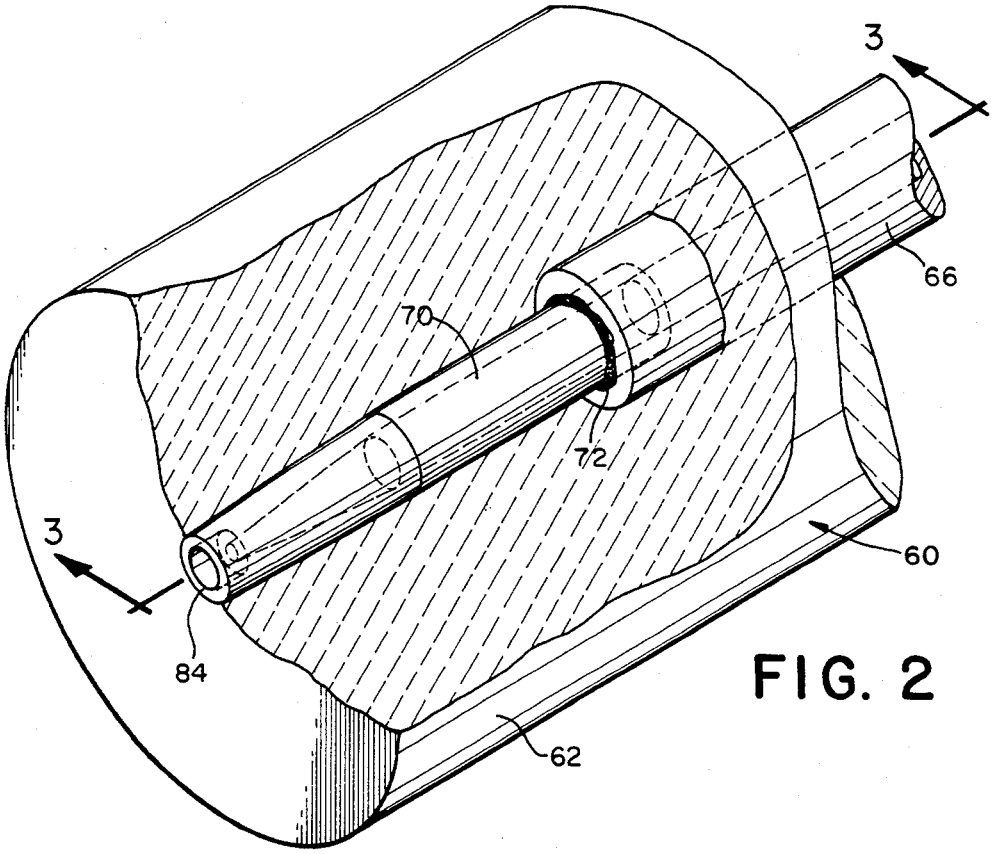
FIG. 2 is a perspective view, partially cut-away, of the nozzle of the invention shown in FIG. 1.
Figure 3:
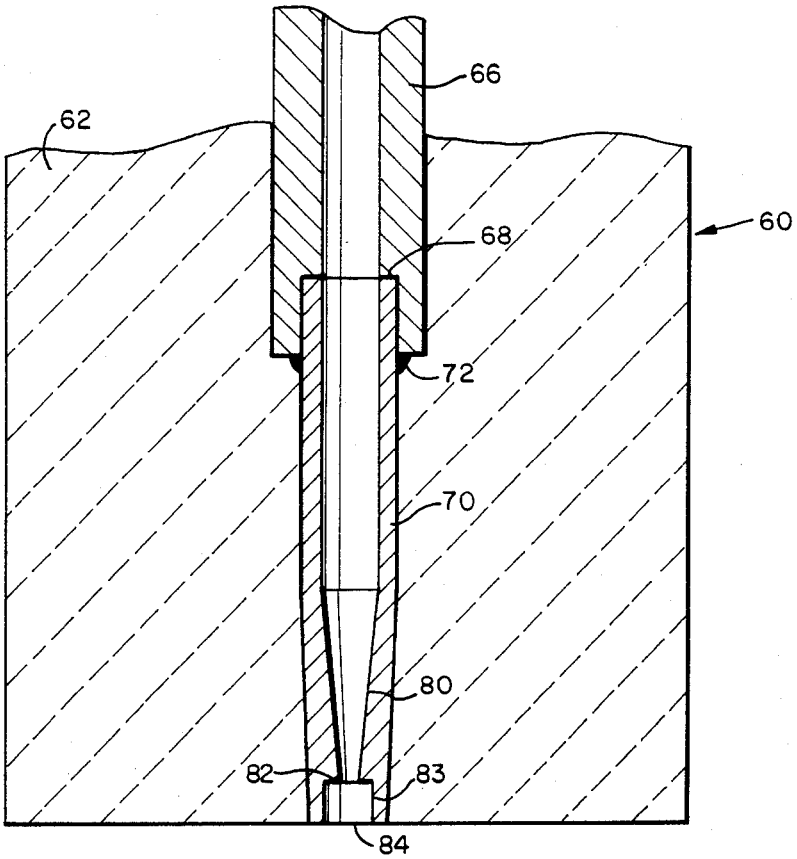
FIG. 3 is a cross-sectional view taken along line 3—3 in FIG. 2.
Figure 4:
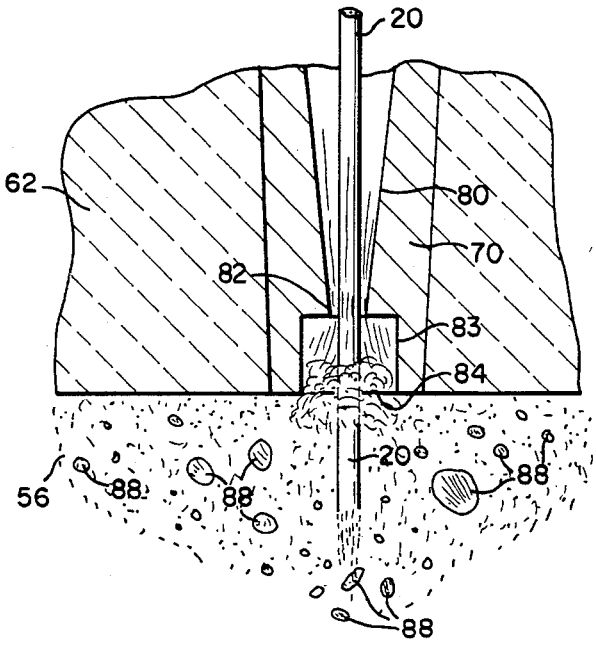
FIG. 4 is a detail view of the point of addition, that is, the outlet of the nozzle, also taken in cross-section along line 3—3 in FIG. 2.

The nozzle 60 of the invention, shown in detail in FIGS. 2 to 4, comprises a refractory ceramic casing 62, through which the calcium wire is conveyed in metallic conduit portions 66 and 70 to the ultimate outlet or discharge point 84. Refractory casing 62 may be made of alumina ($Al_2O_3$) or any other suitable refractory material such as those used to line kilns and the like.

The overall nozzle is made long enough to extend to a preselected depth in the reservoir of molten metal. It is usually preferred that the wire additive be discharged from the nozzle at least 3 to 5 feet below the slag/metal interface. Accordingly, with due regard to the high temperature and corrosive nature of the slag and metal, the refractory casing 62 should be on the order of 10 feet long.

Figure 8:
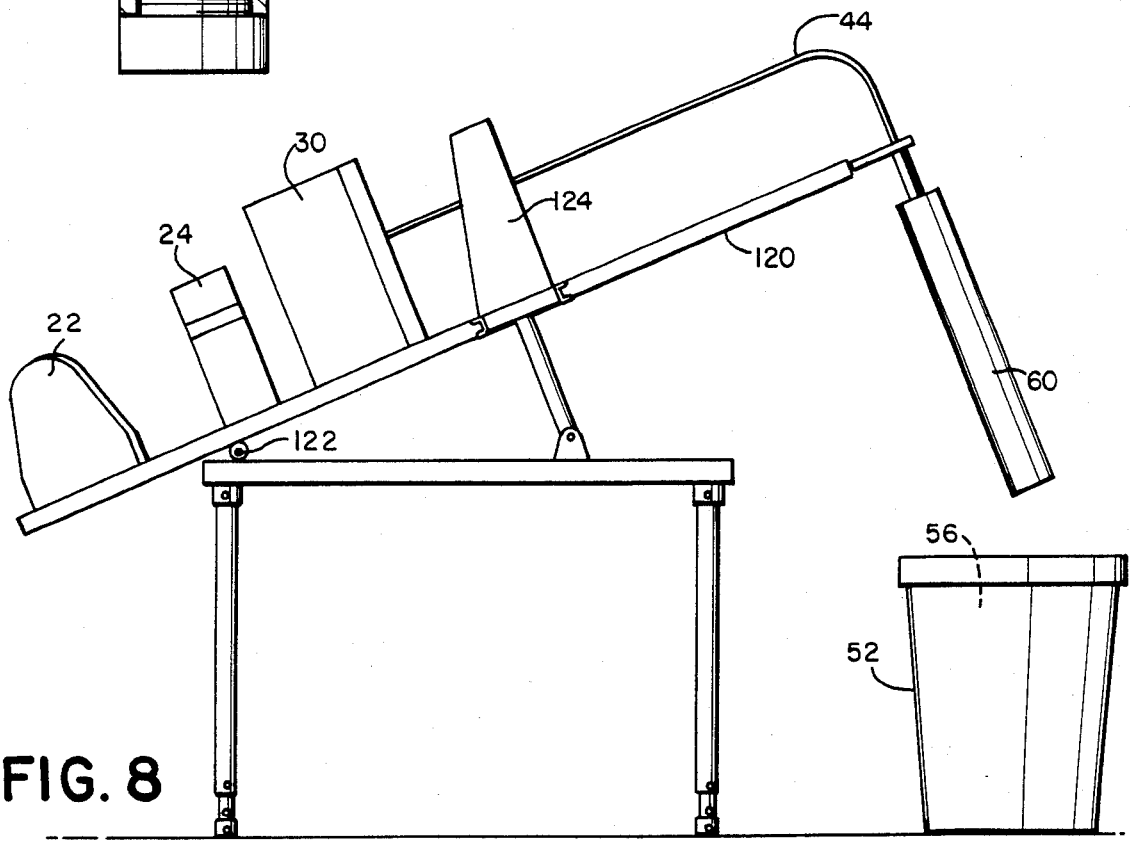
FIG. 8 is an elevation view showing the preferred physical layout of parts shown schematically in FIG. 1.

The nozzle 60 may be raised and lowered with respect to the metal receptacle 52, or vice versa, by means of appropriate mechanical linkages. As shown schematically in FIG. 1, the metal receptacle 52 may be carried by a winch/conveying system, including yoke assembly 48. Alternatively, it may be preferable to raise and lower the entire feed mechanism as a unit, as shown in FIG. 8. In any event, it is beneficial to avoid flexing the conduit 44.

The central wire-carrying portion of nozzle 60 includes a metallic conduit 66 leading to metallic conduit 70, through both of which the wire 20 is passed. The larger conduit 66 carries the wire to near the discharge opening 84 of nozzle 60. An enlarged bore 68 is formed at the end of large conduit 66, into which bore small conduit 70 is placed. Small conduit 70 and large conduit 66 are joined by threads, or by weld 72, or by other convenient means.

As shown in FIG. 4, the discharge end of the smaller conduit 70, at the extreme end of nozzle 60, has an elongated, gradually tapered funnel-shaped section 80 of decreasing internal diameter in the direction of flow. Following the narrower end 82 of the funnel-shaped section, there is an abrupt increase in diameter, formed by a relatively short substantially cylindrical section 83 of substantially uniform diameter. The end of the uniform cylindrical section 83, opposite the narrower end 82 of the funnel-shaped section 80, forms the outlet 84 of the nozzle 60. As shown in FIG. 4, this particular variation in diameter along the direction of wire travel has certain advantages. In particular, the cross-section is adapted to cooperatively prevent the molten metal 56 from running upwards into the nozzle. Otherwise, encroaching molten metal may solidify in the nozzle along the internal areas of conduits 66 and 70 and there bind the wire to the conduit. Simultaneously with exclusion of metal from the nozzle, the inert gas passing outwards through the nozzle together with wire 20 agitates the metal 56, mixing the additive and the molten metal, thus providing for a more even distribution of the additive material. The inert gas also functions to keep the nozzle cool.

In order to add the wire-form additive to the molten metal 56 at a point well below the surface of molten metal, it is necessary to overcome substantial fluid pressure in the molten metal. The fluid pressure is, of course, a function of the depth below the surface of molten metal. The particular pressure will depend upon the particular metal, but will usually be quite substantial at a depth of one or two meters. The pressure of inert gas supplied must overcome this fluid pressure in order to prevent molten metal 56 from rising in the nozzle. Should any molten metal be permitted to run into the nozzle, wire 20 can immediately be seized and welded to a conduit wall as the molten metal solidifies.

The additive material in the form of wire 20 melts after discharge into the reservoir of molten metal 56. Bubbles 88 of inert gas rise toward the surface of molten metal 56, agitating the molten metal and causing an overall flow therein, upwards adjacent the nozzle and downwards at other areas, namely around the periphery of the molten metal reservoir 52.

The decreasing internal diameter of conduit 70 is intended to maximize the gas velocity immediately adjacent the ultimate outlet 84 of the nozzle. Along the area 80 of decreasing cross-section, the gas, at constant pressure, increases in velocity up to the restriction 82. Immediately beyond the restriction, an open cavity or chamber formed by the uniformly cylindrical section 83 of the bore serves to space the restriction 82 from the molten metal 56, further guarding against the entry of molten metal into the restricted orifice 82.

By virtue of the construction described above, the wire is maintained well clear of the lowermost edges of the conduit 70 which are unavoidably exposed to the molten metal, and cannot be welded to these edges by solidifying metal cooled by contact with the nozzle. As the wire 20 is fed, it can be expected to vibrate and rattle around the allowed space in restricted orifice 82. However, the wire remains centrally positioned in the discharge opening 84 even if resting against an edge of the restricted orifice wall. The space which is left open between the wire and the wall of restricted orifice 82 is small enough that the gas pressure overcomes the fluid pressure of displaced molten metal, otherwise tending to flow up the nozzle. Interactive movement of the wire and the inert gas enhance the ability of the nozzle to resist clogging.

Figure 5:
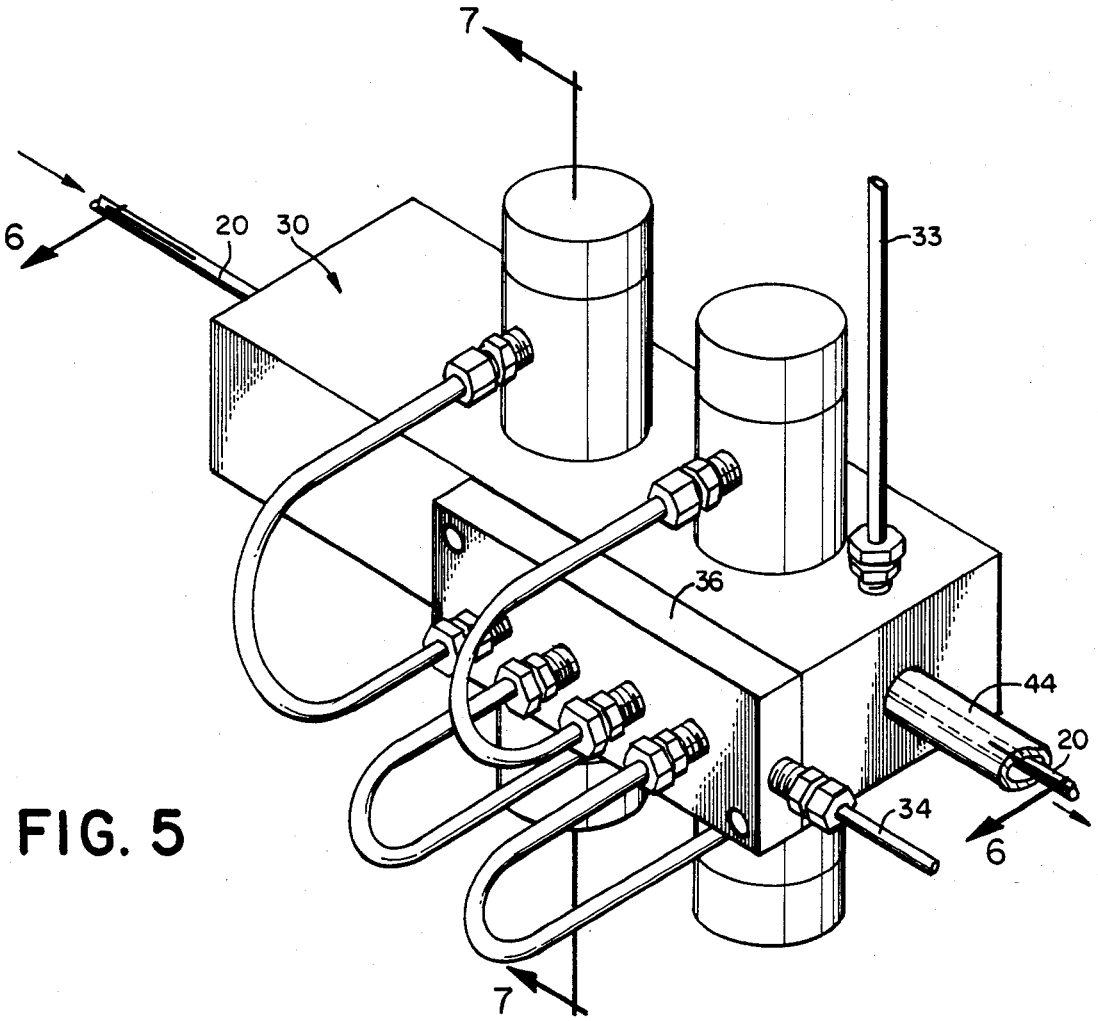
FIG. 5 is a perspective view of the seal device of the invention shown in FIG. 1.
Figure 6:
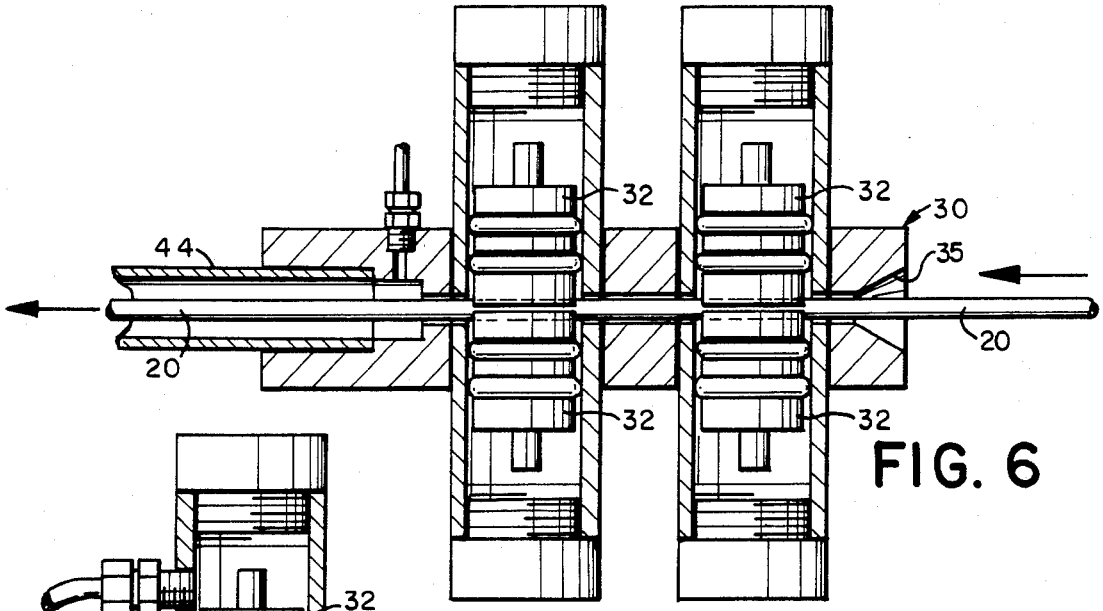
FIG. 6 is a section view taken along line 6—6 in FIG. 5.
Figure 7:
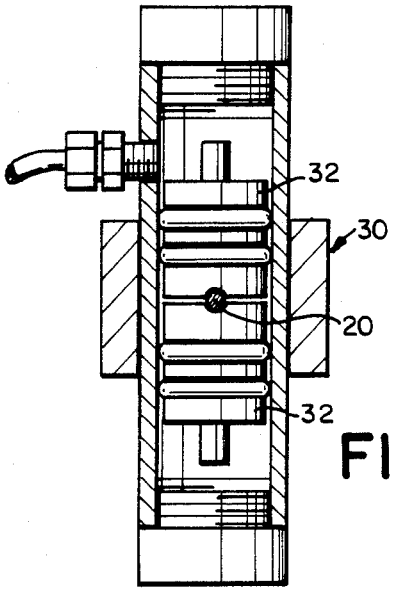
FIG. 7 is a section view taken along line 7—7 in FIG. 5.

Should no provision be made for feeding from some form of sealed inert gas reservoir, a substantial quantity of the inert gas will be vented into the atmosphere and will not function to prevent the entry of molten metal 56 into the nozzle 60. Accordingly, seal mechanism 30 is provided to prevent a backwash of inert gas. Seal mechanism 30 comprises a housing having at least one pair of opposed pistons 32 having contoured sealing surfaces for slidably engaging the wire moving therebetween, which clasp the advancing additive wire 20 in a gas-tight fashion. Downstream of the opposed pistons 32, the inert gas is fed from inert gas source 31 via conduit 33 to the area of wire 20, the wire now being enclosed in a gas-tight conduit 44 leading from seal 30 to the nozzle 60. The particulars of the seal mechanism are shown schematically in FIG. 1 and in more detail in FIGS. 5 to 7. A compressed air source 34 is preferably used to drive opposed pistons 32 against wire 20. Spring biasing, hydraulic pressure or the like are also possible. A manifold 36 may be used to equally distribute the air pressure of compressor 34 or other source. Opposed pistons 32 are slidably mounted in gas-tight cylinders, and sealed therein by means of resilient "O"-rings, for example two per piston. The equalization of gas pressure by means of manifold 36 results in equal pressure on opposed pairs of axially aligned pistons 32, at each stage thereof. Two stages or pairs of opposed pistons are shown, disposed in parallel relationship. It will be appreciated that the opposed pistons may likewise be mounted at right angles, or as otherwise desired. The pairs may also be operated independently such that one pair provides an atmosphere seal and the other pair provides an inert gaseous medium seal.

The housing of seal unit 30 is preferably made of steel. The pistons 32, mounted in the cylinders of the housing, are made of a durable plastic material. The pistons may, for example, be made from or coated with teflon, nylon, or the like.

The housing of seal 30 is provided with an enlarged, funnel-shaped input orifice 35, adapted to "capture" the advancing end of wire 20. It may be necessary to additionally spring-bias opposed pistons 32, or provide for a manual adjustment, in order to ensure their central alignment during the initial loading of wire 20. Once loaded, however, the seal mechanism 30 will compensate for variation in the transverse position of wire 20 with respect to the seal 30, while maintaining the gas-tight seal thereof. Inasmuch as the sheathed wire is quite stiff, it is necessary to allow some variation in alignment in order to prevent undue friction and to maintain the seal.

A suitable control mechanism may be connected simultaneously to the pinch roller wire feed device 24 and to the inert gas pressure control 42. To avoid waste, the gas control 42 should be left closed until the wire becomes engaged by opposed pistons 32 of seal 30. In any event, no particular gas pressure is required until the injector nozzle 60 is brought into proximity with the molten metal 56, or the slag 54 thereupon. At this point, the feeder and inert gas pressure control may be simultaneously activated, and the nozzle plunged into the molten metal. Melting additive and inert gas are discharged at the nozzle orifice, well below the slag/metal interface.

A preferred physical arrangement of the system is shown in FIG. 8. Virtually the entire system is disposed upon a pivotally-mounted table 120, which pivots on hinge 122. A hydraulic or pneumatic lifting device 124 is operable to lift and lower the table 120 about its pivot, thereby raising and lowering nozzle 60 with respect to the molten metal 56 in container 52. The lifting mechanism may likewise be incorporated under the common inert gas/wire feed control.

It will be appreciated that the present invention resides both in the apparatus and in the method by which the apparatus is used to incorporate the additive material, as well as in the nozzle and sealing means themselves.

The nozzle is formed with a bore having, with respect to the direction of additive feed and inert gas flow, a substantially cylindrical section of substantially uniform diameter, followed by a tapered section of decreasing diameter terminating at an aperture having a radius only slightly larger than that of the wire and a second substantially cylindrical section of substantially uniform diameter larger than that of said aperture, whereby the wire remains spaced from the internal edges of the nozzle conduit adjacent the outlet. An abrupt transition between the tapered and second cylindrical sections creates a restricted diameter orifice with increased gas velocity therein, past which orifice the molten metal does not backflow.

The essential features of the invention having been disclosed, further variations will now become apparent to persons skilled in the art. Reference should be made to the appended claims, rather than the foregoing specification, as indicating the true scope of the subject invention.

I claim:

1. An apparatus for injecting a processing element in the form of a wire below the surface of a molten material, comprising:

a heat resistant nozzle, movable into an operative position wherein an inlet is disposed above said surface and an outlet is disposed below said surface, with said nozzle being provided with a bore having a funnel-shaped section terminating at its narrower end in a substantially circular aperture and a substantially cylindrical section of substantially uniform diameter into which said aperture opens, said funnel-shaped and substantially uniform diameter sections being concentric, said substantially uniform diameter being larger than the diameter of said aperture and the axial length of said uniform diameter section comprising only a minor portion of the axial length of the nozzle, and with the opening at the end of said substantially uniform diameter section opposite said aperture forming the outlet of the nozzle;

a gas-tight conduit connected at one end to the nozzle inlet;

means disposed at the other end of the conduit for sealably receiving the wire;

means for injecting an inert gas into the conduit; and means for feeding the wire into and through the conduit and nozzle and directly into the interior of the molten material, whereby the injected wire is centered in said nozzle outlet and inert gas leaving the nozzle outlet together with the wire substantially prevents closure of the outlet by solidified molten material and facilitates mixture of the processing element into the molten material through gas bubble agitation.

2. The apparatus of claim 1 wherein the funnel-shaped section is relatively longer axially than the uniform diameter section.

3. The apparatus of claim 1 wherein said means for injecting an inert gas comprises:

a pressurized source of inert gas; and, means for connecting said source to the means for sealably receiving the wire immediately upstream of the end of the conduit.

4. The apparatus of claim 1 wherein said means for sealably receiving the wire comprises:

at least one pair of pressure activated pistons disposed coaxially and movable toward one another, the pistons having contoured sealing surfaces for slidably engaging the wire moving therebetween;

a gas manifold for driving the pistons under equal pressure; and a pressurized gas source for the manifold.

5. An apparatus for injecting a processing element in the form of a wire below the surface of a molten material, comprising:

a heat resistant nozzle, movable into an operative position wherein an inlet is disposed above said surface and an outlet is disposed below said surface;

a gas-tight conduit connected at one end to the nozzle inlet;

means disposed at the other end of the conduit for sealably receiving the wire, said means comprising at least one pair of pressure activated pistons disposed coaxially and movable toward one another, with the pistons having contoured sealing surfaces for slidably engaging the wire moving therebetween;

means for injecting an inert gas into the conduit; and means for feeding the wire into and through the conduit and nozzle and directly into the interior of the molten material, whereby inert gas leaving the nozzle outlet together with the wire substantially prevents closure of the outlet by solidified molten material and facilitates mixture of the processing element into the molten material through gas bubble agitation.

6. The apparatus of claim 5 wherein said means for sealably receiving the wire further comprises a gas manifold for driving the pistons under equal pressure and a pressurized gas source for the manifold.

7. The apparatus of claim 5 wherein said means for sealably receiving the wire comprises two pairs of pistons separated from one another along the direction of wire feeding, with one of said pairs forming an atmosphere seal and the other forming an inert gas seal.

8. The apparatus of claim 5 wherein said means for injecting an inert gas comprises:

a pressurized source of inert gas; and means for connecting said source to the means for sealably receiving the wire downstream of the at least one pair of pistons and upstream of the conduit.

9. The apparatus of claim 8 wherein said nozzle is provided with a bore having a funnel-shaped section terminating at its narrower end in an aperture having a radius only slightly larger than that of the wire and a substantially cylindrical section of substantially uniform diameter into which said aperture opens, with the opening at the end of said substantially uniform diameter section opposite said aperture forming the outlet of the nozzle.

10. The apparatus of claim 8 wherein said means for sealably receiving the wire comprises two pairs of pistons separated from one another along the direction of wire feeding, with one of said pairs forming an atmosphere seal and the other forming an inert gas seal.

11. An apparatus for adding a processing element in the form of a wire directly into a molten material, comprising:

a heat resistant nozzle positionable relative to the surface of the molten material such that an inlet is disposed above said surface and an outlet is disposed beneath said surface, with said nozzle being provided with a bore having an elongated, funnel-shaped section which terminates at its narrower end in a substantially circular aperture which opens into a substantially cylindrical chamber-like section of substantially uniform diameter, said funnel-shaped and substantially uniform diameter sections being concentric, said substantially uniform diameter being larger than the diameter of said aperture and the axial length of said uniform diameter section comprising only a minor portion of the axial length of the nozzle, and the opening at the end of said substantially uniform diameter section opposite said funnel-shaped section forming an outlet of the nozzle;

means for feeding the wire through the nozzle directly into the molten material; and means for injecting a substantially inert gaseous medium through the nozzle and into the molten material together with the wire, whereby the wire is centered in said nozzle outlet and said inert gas substantially prevents closure of the nozzle by solidified molten material and promotes mixture of the processing element with the molten material through gas bubble agitation.

12. The apparatus of claim 11 further comprising a substantially gas-tight conduit connected to the nozzle inlet, through which conduit the wire and the inert gaseous medium are delivered to the nozzle.

13. The apparatus of claim 12 further comprising means for sealing said conduit as the wire enters it.

14. The apparatus of claim 13 wherein said sealing means comprises:

first and second pairs of pressure activated pistons, each pair disposed coaxially and movable toward one another, the pistons having contoured sealing surfaces for slidably engaging the wire moving therebetween, the first pair forming an atmosphere seal and the second pair forming an inert gaseous medium seal.

15. An apparatus for adding a processing element in the form of a wire directly into a molten material, comprising:

a heat resistant nozzle positionable relative to the surface of the molten material such that an inlet is disposed above said surface and an outlet is disposed beneath said surface;

means for feeding the wire through the nozzle directly into the molten material;

means for injecting a substantially inert gaseous medium through the nozzle and into the molten material together with the wire, whereby said inert gas substantially prevents closure of the nozzle by solidified molten material and promotes mixture of the processing element with the molten material through gas bubble agitation;

a substantially gas-tight conduit connected to the nozzle inlet, through which conduit the wire and the inert gaseous medium are delivered to the nozzle; and means for sealing said conduit as the wire enters it comprising first and second pairs of pressure activated pistons, each pair disposed coaxially and movable toward one another, the pistons having contoured sealing surfaces for slidably engaging the wire moving therebetween, the first pair forming an atmosphere seal and the second pair forming an inert gaseous medium seal.

16. The apparatus of claim 15 wherein said sealing means further comprises a gas manifold for driving the pistons under equal pressure.

17. A nozzle for injecting a processing element in the form of a wire directly into the interior of molten material and the like, comprising an elongated casing formed from highly temperature resistant material, the nozzle having an axial bore through which the wire may be fed directly into the molten material, and said bore having a termination opening through which the wire exits the nozzle, a restriction in diameter upstream of the termination opening, a funnel-shaped section upstream of said restriction, said funnel-shaped section being tapered in the downstream direction, and a section of substantially uniform diameter downstream of said restriction and adjacent the termination opening, said substantially uniform diameter being larger than the diameter of said restriction and the axial length of said uniform diameter section comprising only a minor portion of the axial length of the nozzle, whereby the injected wire is centered relative to said termination opening.

18. The nozzle of claim 17 wherein said funnel-shaped section is relatively longer axially than said uniform diameter section.

19. An apparatus for sealing the entrance to a wire carrying conduit comprising:

a housing, having a bore through which the wire passes into the conduit and having at least one pair of aligned cylinders opening into the bore; and a pressure activated piston disposed in each of the cylinders, the pistons having contoured sealing surfaces for slidably engaging the wire moving therebetween and for sealably engaging one another over the wire.

20. The apparatus of claim 19 further comprising a pressurized gas source for driving the pistons.

21. The apparatus of claim 20 further comprising a gas manifold disposed between the pressurized gas source and the pistons for driving the pistons under equal pressure.

22. The apparatus of claim 21 comprising two pairs of aligned cylinders spaced from one another along the bore and a pair of pressure activated pistons disposed in each pair of cylinders, whereby a gas may be sealably injected into the conduit, with one of the cylinder/piston pairs forming an atmosphere seal and the other cylinder/piston pair forming an injected gas seal.

23. The apparatus of claim 22 comprising a pressurized gas source for driving the pistons.

24. The apparatus of claim 23 further comprising a gas manifold disposed between the pressurized gas source and the pistons for driving the pistons under equal pressure.

* * * * *